US008974107B2

(12) United States Patent
Hsiao

(10) Patent No.: US 8,974,107 B2
(45) Date of Patent: Mar. 10, 2015

(54) SYSTEM HAVING A LAMP ASSEMBLED WITH AN AROMA CAPSULE THAT DISPERSES SCENT

(71) Applicant: Ming Jen Hsiao, Road Town (VG)

(72) Inventor: Ming Jen Hsiao, Road Town (VG)

(73) Assignee: Serene House International Enterprise Ltd. (VG)

( * ) Notice: Subject to any disclaimer, the term of this patent is extended or adjusted under 35 U.S.C. 154(b) by 124 days.

(21) Appl. No.: 13/663,305

(22) Filed: Oct. 29, 2012

(65) Prior Publication Data

US 2014/0118992 A1 May 1, 2014

(51) Int. Cl.
*F21V 33/00* (2006.01)

(52) U.S. Cl.
USPC ..... 362/643; 362/96; 362/253

(58) Field of Classification Search
CPC .... A61L 9/03; A61L 2209/12; F21V 33/0088
USPC ..... 362/643, 96, 253, 447, 810
See application file for complete search history.

(56) References Cited

U.S. PATENT DOCUMENTS 4,493,011 A * 1/1985 Spector ..... 362/96
5,575,992 A * 11/1996 Kunze ..... 424/76.4
8,066,420 B2 11/2011 Hsiao
8,147,116 B1 4/2012 Hsiao
8,262,277 B2 9/2012 Hsiao

* cited by examiner

*Primary Examiner* — Diane Lee
*Assistant Examiner* — Naomi M Wolford
(74) *Attorney, Agent, or Firm* — Chun-Ming Shih

(57) ABSTRACT

An aroma capsule assembly lamp system that disperses scent fast is provided, including a lamp and an aroma capsule. The lamp includes a support stand, a lamp stand installed on the support stand, a light bulb installed on the lamp stand, and a lamp cover installed on the support stand and covering the light bulb and the lamp stand, the lamp cover having a top opening. The aroma capsule is installed in the top opening of the lamp cover and includes a disposable container. The disposable container has an opening and an aroma material disposed in the disposable container. The light bulb is supplied with power and emits radiation light, the radiation light heating the disposable container and the aroma material, facilitating the system to disperse scent. When emitting radiation light, the light bulb of the lamp also generates heat at the same time, which heats the aroma material to disperse scent.

10 Claims, 3 Drawing Sheets

SYSTEM HAVING A LAMP ASSEMBLED WITH AN AROMA CAPSULE THAT DISPERSES SCENT

CROSS-REFERENCES TO RELATED APPLICATION

Two pending new application Ser. No. 13/543,490 and Ser. No. 13/549,493 filed on Jul. 15, 2012 are hereby incorporated by reference.

BACKGROUND OF THE INVENTION

1. Field of the Invention

This invention relates to scent dispersing devices, and, more particularly, to a system having a lamp assembled with an aroma capsule that disperses scent.

2. Description of Related Art

U.S. Pat. Nos. 8,066,420, 8,262,277 and 8,147,116 disclose an aroma lamp, which includes a light bulb that emits light and heats aroma wax. The aroma lamp has a complicated mechanical structure and a high manufacturing cost. A user needs to prepare a certain container for the aroma wax to be contained therein. The user also needs to take the aroma wax out from the container carefully and place the aroma wax in a ceramic receiving trough above a support stand, for the aroma wax to be heated by the light bulb. When taking the aroma wax out from the container, the user is likely to be stained by the aroma wax. After the aroma material is evaporated completely, the user has to wash and clean the receiving trough. If the receiving trough is not sufficiently clean and another aroma material that disperses different scent from the previous aroma material is placed in the receiving trough, the user will smell unexpected scent. The receiving trough is made of a fragile material (e.g., a ceramic product), and is likely to be broken when being washed.

SUMMARY OF THE INVENTION

In view of the problems of the prior art, the present invention provides a system comprising a lamp and an aroma capsule. The lamp includes a support stand, a lamp stand installed on the support stand, a light bulb installed on the lamp stand, and a lamp cover installed on the support stand and covering the light bulb and the lamp stand, the lamp cover having a top opening. The aroma capsule is installed in the top opening of the lamp cover and includes a disposable container. The disposable container has an opening and an aroma material disposed in the disposable container. The light bulb is supplied with power and emits radiation light, the radiation light heating the disposable container and the aroma material, facilitating the system to disperse scent.

The present invention provides two functions at the same time, including emitting light and dispersing scent, to achieve the purposes of lighting and providing a pleasant mood. Besides, it is convenient for a user to use the aroma material such that the problem of the prior art is solved that the user has to prepare a complicated machine that heats the aroma material to disperse scent. Since having a simple structure and a low manufacturing cost and is safe and easy to use, the system provided by the present invention is likely to achieve a remarkable commercial success.

BRIEF DESCRIPTION OF DRAWINGS

The invention can be more fully understood by reading the following detailed description of the preferred embodiments, with reference made to the accompanying drawings, wherein.

DETAILED DESCRIPTION OF THE INVENTION

The following illustrative embodiments are provided to illustrate the disclosure of the present invention, these and other advantages and effects can be apparently understood by those in the art after reading the disclosure of this specification. The present invention can also be performed or applied by other different embodiments. The details of the specification may be on the basis of different points and applications, and numerous modifications and variations can be devised without departing from the spirit of the present invention.

Figure 1:
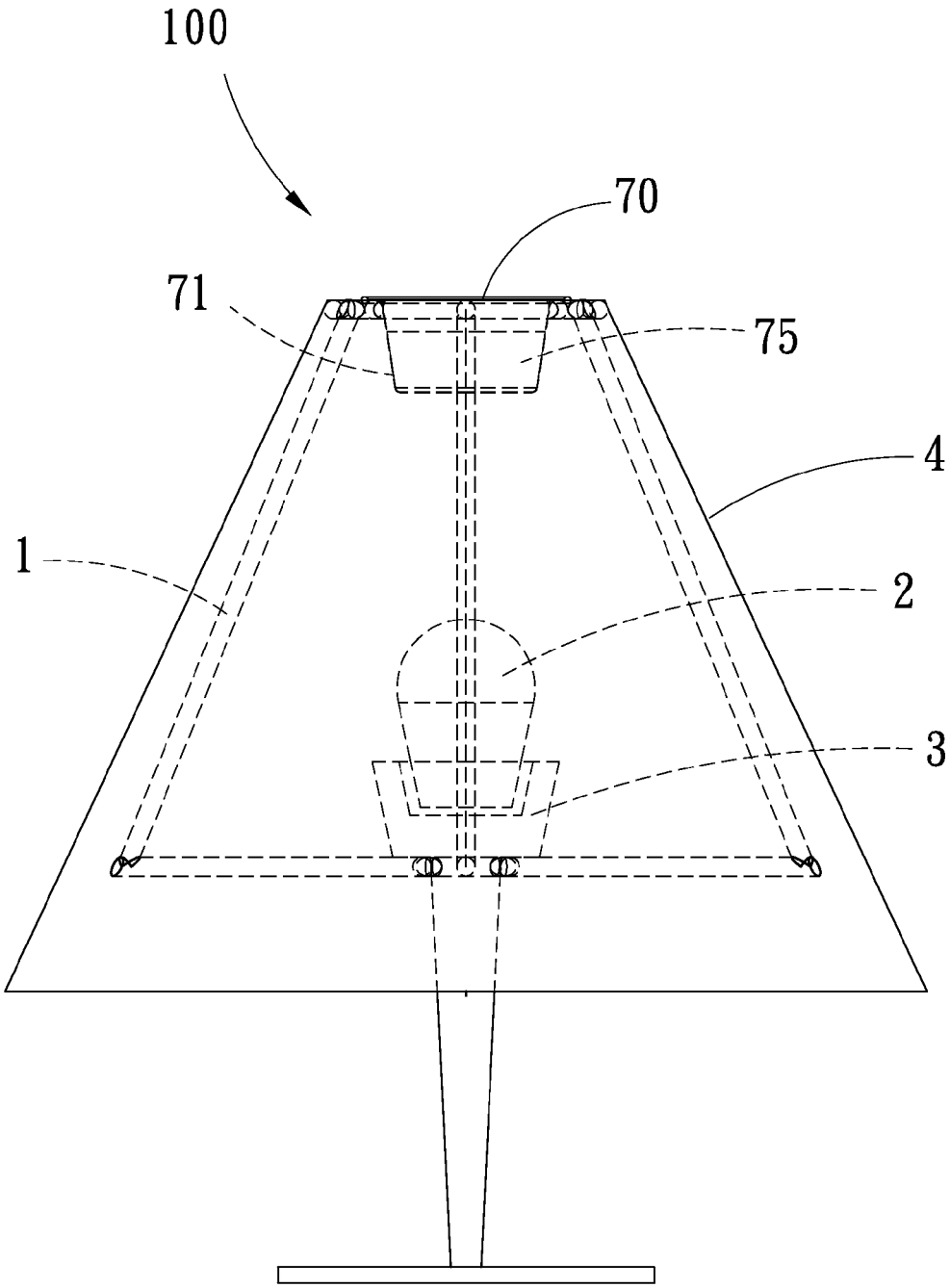
FIG. 1 is a perspective diagram of a system having a lamp assembled with an aroma capsule according to the present invention.
Figure 2:
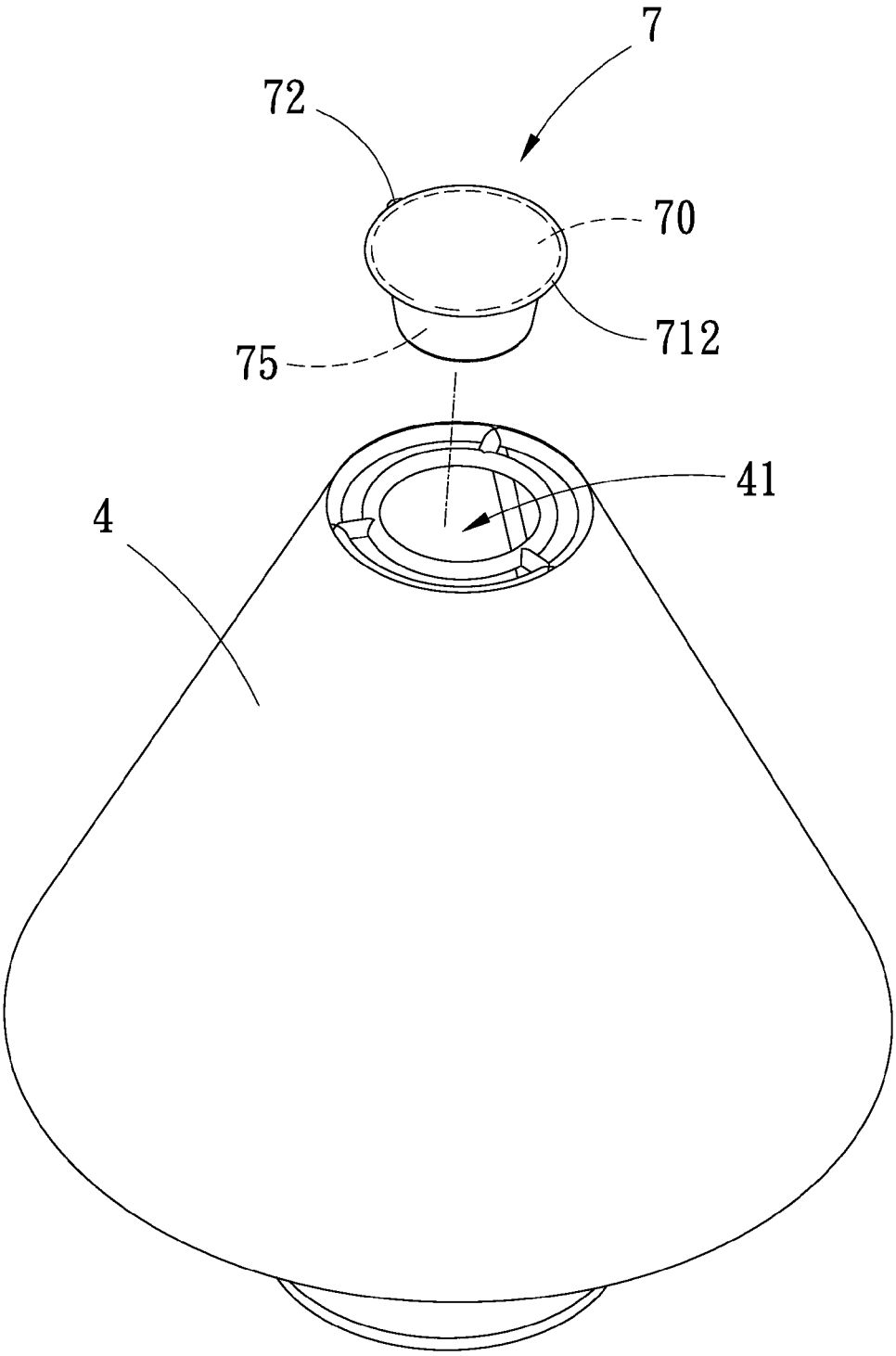
FIG. 2 is a schematic diagram illustrating that the aroma capsule is going to be assembled to a lamp.
Figure 3:
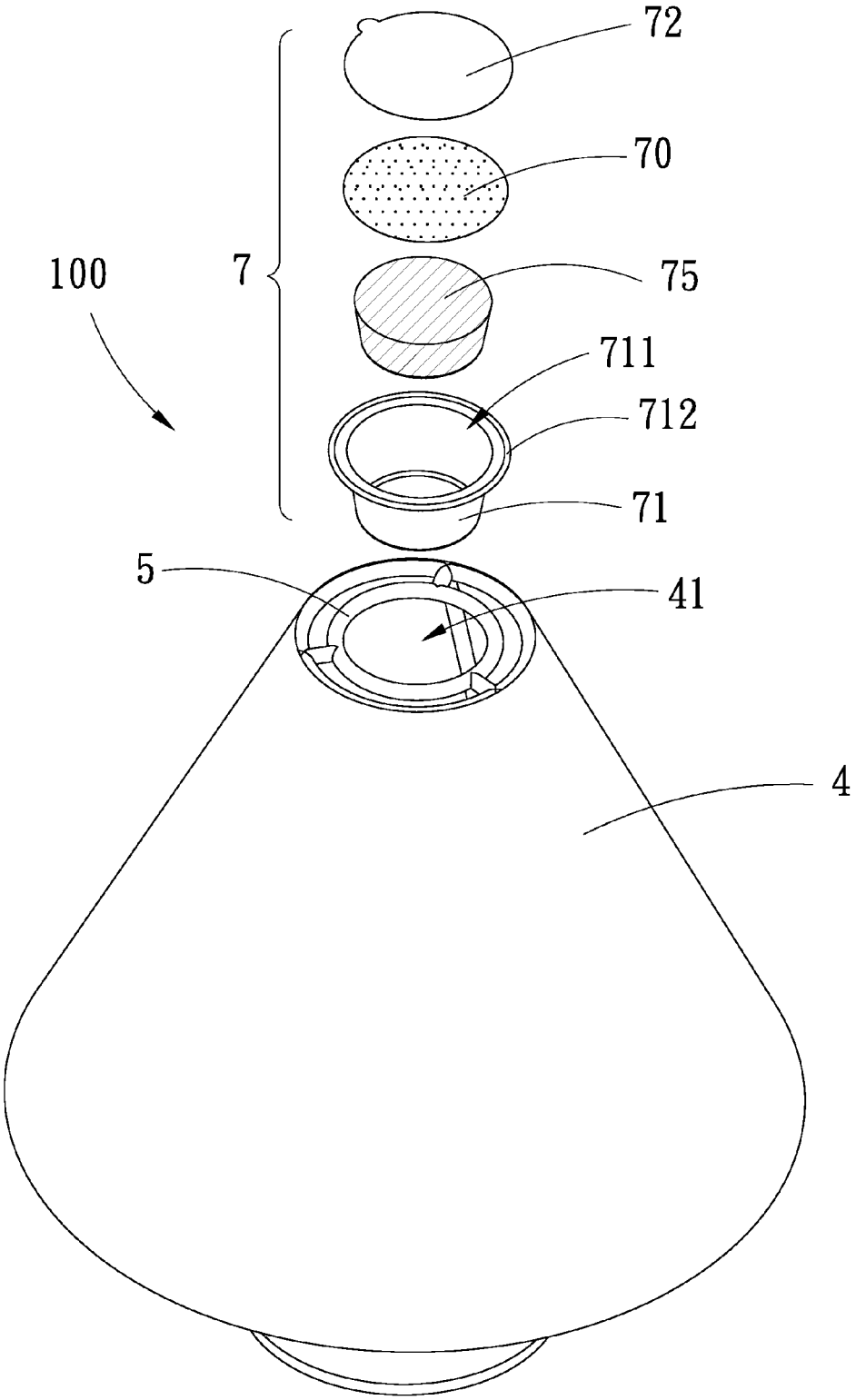
FIG. 3 is an exploded diagram of a system having a lamp assembled with an aroma capsule that disperse scent fast.

Referring to FIGS. 1-3, a system having a lamp assembled with an aroma capsule that disposes scent fast is provided. The system comprises a lamp 100. The lamp 100 includes a support stand 1, a lamp stand 2 installed on the support stand 1, a light bulb 3 installed on the lamp stand 2, a lamp cover 4 installed on the support stand 1 and covers the light bulb 3 and the lamp stand 2. The lamp cover 4 has a top opening. The system further comprises an aroma capsule 7 disposed in the top opening of the lamp cover 4. The aroma capsule 7 has a disposable container 71. The disposable container 71 has an opening 711 and an aroma material 75 disposed in the disposable container 71.

The light bulb 3 can be supplied with power and emit radiation light, which heats the disposable container 71 and the aroma material 75 to disperse scent.

In an embodiment, the disposable container 71 of the aroma capsule 7 comprises a sealing cover 72 (shown in FIG. 3), for protecting an aroma material (e.g., aroma wax) in the aroma capsule 7 from being contaminated or dispersing scent during transportation. A user is allowed to lift the sealing cover 72, and place the disposable container 71 of the aroma capsule 7 in the top opening 11 of the support stand 1.

Referring to FIGS. 1 and 3, in a preferable embodiment of the present invention the aroma capsule 7 further comprises a ventilation film 70 combined with the opening 711.

In an embodiment, the aroma capsule 7 further comprises a sealing cover 72 (shown in FIG. 3). The sealing cover 72 seals the opening 711, and covers the aroma material 75 and the ventilation film 70. Therefore, the sealing cover 72 prevents the aroma material 75 (aroma wax) in the aroma capsule 7 from dispersing scent during storage and transportation, and protects the air vents of the ventilation film 70 from being contaminated.

In an embodiment, the aroma material 75 is an aroma block, and the aroma block is aroma wax or essence block.

In general, an aroma material melts or evaporates to disperse scent at 35-75° C. In a preferable embodiment of the present invention, the aroma material 75 is aroma wax, and the aroma wax can disperse scent as long as the light bulb 3 heats the aroma wax up to the temperature. In an embodiment, the aroma material 75 is preferable aroma wax, which melts and disperse scent at 35-75° C. That is to say, the light bulb 3 only needs to heat the aroma wax up to the temperature, and the aroma wax will disperse scent into the ambient. Accordingly, the disposable container 71 is made of a material that is not melted or deformed at 35-75° C. and can conduct the heat generated by the light bulb 3 to the aroma material 75. In an embodiment, the disposable container 71 is made of metal, hard plastic, fiber bowl (e.g., plant fiber such as corn fiber, glass fiber and carbon fiber), or a composite material.

In an embodiment, the disposable container 71 is an aluminum foil bowl that is made of metal such as foil. Therefore, the disposable container 71 is light and thin, has a good enough heat conduction capability, and can conduct heat generated by the light bulb 3 to the aroma material 75 to heat the aroma material 75 to disperse scent. The aluminum foiled disposable container 71 is durable and is unlikely to be broken, unlike the ceramic bowl and glass container used by the conventional heating device to receive essence oil and aroma wax that are likely to be broken. Besides, the sealing cover 72 seals the aroma material 75 or other types of aroma materials into the aluminum foiled disposable container 71 such that the quality of the aroma material is ensured.

Since the aroma material 75 is placed in the disposable container 71, rather than placed in the conventional container, a user, when using the aroma material 75, only needs to lift the sealing cover 72 (referring to FIGS. 1-3), and will not be stained by the aroma material 75. After the aroma material 75 is heated and evaporated completely in the top opening 11 of the support stand 1, if wanting to use another aroma material that disperses different scent from the previous aroma material, the user may dispose the disposable container 71 from the top opening 11 of the support stand 1 and place another aroma capsule 7 that has the another aroma material in the top opening 11 of the support stand 1 top opening 11. Since the disposable container 71 is made of an aluminum foil, the user does not need to wash or clean or worry about breaking the disposable container 71. An additional container for the aroma material 75 to be contained therein is also not necessary.

In an embodiment, the air vents of the ventilation film 70 guides scent dispersed by the aroma wax upward into the ambient. The ventilation film 70 may be made of a fabric (e.g., a non-woven fabric, a fiber fabric, linen and canvas), a fiber sheet, a ventilation film or a ventilation metal foil. A user can lift the sealing cover 72 and place the disposable container 71 in the top opening 11 of the support stand 1 such that the aroma material 75 contained in the disposable container 71 is heated by the light bulb 3 and melts to disperse scent. When the lamp, the light bulb 3 or the disposable container 71 is toppled by chance, the melted aroma wax is blocked by the ventilation film 70 and does not flows out from the disposable container 71 to the lamp, the light bulb 3 or other places. Therefore, the system is safe.

In an embodiment, as shown in FIGS. 1-3, in the system having the lamp assembled with the aroma capsule that disperse scent the lamp 100 further comprises a commodity rack 5 combined with an upper side of the support stand 1 and corresponding to the top opening 41 of the lamp cover 4. The commodity rack 5 is commensurate in size with the aroma capsule 7 for the aroma capsule 7 to be just placed therein.

In a system having a lamp assembled with an aroma capsule that disperse scent, since the commodity rack 5 is commensurate in size with the aroma capsule 7, the aroma capsule 7 can be placed in the commodity rack 5 securely.

In an embodiment, the commodity rack 5 has a round rack body that has a shape matching with the shape of the disposable container 71 of the aroma capsule 7. The disposable container 71 further has an outer ring flange 712 disposed on an upper end thereof, allowing the disposable container 71 to be mounted to an inner side of the round commodity rack 5. The outer ring flange 712 of the disposable container 71 can be locked to the commodity rack 5 (referring to FIG. 1). In an embodiment, since the lamp cover 4 and the commodity rack 5 are widely employed by a general lamp, the system can be used by common consumers. A consumer can left the sealing cover 72 and place the aroma capsule 7 in the commodity rack 5 disposed on the inner side of the top opening 41 of the lamp cover 4 quickly. When the lamp emits light, the aroma material 75 disperse scent into the ambient at the same time, thus achieving the purpose of simultaneously lighting and dispersing scent. It is easy to use the aroma material 75 to disperse scent. Therefore, the problem of the prior art that a user has to prepare a complicated machine is solved. Since having a simple structure and a low manufacturing cost and is safe and easy to use, the system provided by the present invention is likely to achieve a remarkable commercial success.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. A system having a lamp assembled with an aroma capsule, comprising:

a lamp, including:

a support stand;

a lamp stand installed on the support stand;

a light bulb installed on the lamp stand;

a lamp cover installed on the support stand and covering the light bulb and the lamp stand, the lamp cover having a top opening; and a ring shape commodity rack installed on a top side of the support stand and corresponding in position to the top opening of the lamp cover; and an aroma capsule installed in the top opening of the lamp cover and including a disposable container, the disposable container being circled by the ring shape commodity rack and having an opening, and an aroma material being disposed in the disposable container;

wherein the disposable container further has an outer ring flange disposed on an upper end thereof, and the ring shape commodity rack abuts against the outer ring flange to hold the disposable container; and wherein the light bulb is supplied with power and emits radiation light, the radiation light heating the disposable container and the aroma material, facilitating the system to disperse scent.

2. The system of claim 1, wherein the aroma capsule further comprises a ventilation film combined with the opening.

3. The system of claim 2, wherein the ventilation film is made of fabric, fiber sheet, ventilation glue film, or ventilation metal foil.

4. The system of claim 1, wherein the aroma capsule further comprises a sealing cover that seals the opening, the sealing cover covering the aroma material and the ventilation film.

5. The system of claim 1, wherein the aroma material is aroma wax.

6. The system of claim 1, wherein the disposable container is made of metal, hard plastic, a fiber bowl, or a composite material.

7. The system of claim 6, wherein the metal disposable container is an aluminum foil bowl.

8. The system of claim 1, wherein the ring shape commodity rack is commensurable with the aroma capsule in size for the aroma capsule to be placed thereon and fixed thereto.

9. The system of claim 1, wherein the ring shape commodity rack is commensurable with the aroma capsule in shape for the aroma capsule to be placed thereon and fixed thereto.

10. The system of claim 9, wherein the ring shape commodity rack is round.

* * * * *